US005660560A

United States Patent [19]

Cheng et al.

[11] Patent Number: 5,660,560

[45] Date of Patent: Aug. 26, 1997

[54] WATER-TIGHT LAMP SOCKET

[76] Inventors: You-jen Cheng; Tzu-ling Cheng, both of 2nd Fl., 18-9, Tienmu W. Road, Taipei City, Taiwan

[21] Appl. No.: 576,218

[22] Filed: Dec. 22, 1995

[51] Int. Cl.[6] ..... H01R 4/24

[52] U.S. Cl. ..... 439/419; 439/280

[58] Field of Search ..... 439/419, 417, 439/414, 271, 280, 306, 336, 339, 340, 356

[56] References Cited

U.S. PATENT DOCUMENTS

| | | | |
|---|---|---|---|
| 2,119,452 | 5/1938 | Woodhead | 439/271 |
| 2,570,751 | 10/1951 | Benander | 439/419 |
| 3,101,984 | 8/1963 | Wiechmann | 439/271 |
| 3,128,141 | 4/1964 | Krupp et al. | 439/419 |
| 3,716,818 | 2/1973 | Finkelstein | 439/419 |
| 4,382,654 | 5/1983 | Schick | 439/602 |
| 4,653,829 | 3/1987 | LaMont | 439/409 |
| 4,660,916 | 4/1987 | Williams, Jr. | 439/271 |
| 5,421,742 | 6/1995 | Huang | 439/419 |
| 5,446,640 | 8/1995 | Lin | 439/419 |
| 5,474,467 | 12/1995 | Chen | 439/419 |
| 5,492,483 | 2/1996 | Cheng et al. | 439/419 |

FOREIGN PATENT DOCUMENTS

| | | | |
|---|---|---|---|
| A014793 | 2/1912 | France | 439/271 |
| 853183 | 10/1952 | Germany | 439/419 |
| 119539 | 10/1918 | United Kingdom . | |
| 412939 | 7/1934 | United Kingdom | 439/419 |
| 2253045 | 8/1992 | United Kingdom . | |

*Primary Examiner*—David L. Pirlot
*Assistant Examiner*—Tho D. Ta
*Attorney, Agent, or Firm*—Ladas & Parry

[57] ABSTRACT

A water-tight lamp socket which includes a rubber packing ring mounted around the socket body and having two recessed portions disposed at two opposite ends of the wire groove on the socket body, two water sealing retainers respectively mounted around the electric wire in the wire groove of the socket body and set in the recessed portions of the rubber packing ring and held down by the socket cap of the lamp socket to seal the gap of the wire groove, and a water sealing ring mounted within the socket body to seal the gap between the socket body and the lamp bulb.

2 Claims, 3 Drawing Sheets

WATER-TIGHT LAMP SOCKET

BACKGROUND OF THE INVENTION

The present invention relates to lamp sockets for Christmas tree light sets, and relates more particularly to a water-tight lamp socket which prohibits water from entering the inside to damage the electric circuit.

Regular lamp sockets for Christmas tree light set are generally comprised of a socket body having a center metal contact plate and a side metal contact plate, a socket cap fastened to the socket body to hold down the electrical wire against the center metal contact plate and the side metal contact plate. When the socket cap is fastened to the socket body, the pointed tips of the center metal contact plate and the side metal contact plate are forced to pierce the insulator of the electrical wire and to make electrical contact with a respective conductor in the electric wire. When the base of the lamp bulb is threaded into the internally threaded socket body, the tip contact and ring contact of the lamp bulb are forced into contact with the center metal contact plate and the side metal contact plate, and therefore the electric circuit is closed, and the lamp bulb is lightened. This structure of lamp socket is functional, however it not suitable for use outdoors during a rainy day because it cannot effectively prevent rain water from passing to the inside. If to touch the lamp socket with the hand when it is covered with rain water, an electric shock tends to occur.

SUMMARY OF THE INVENTION

The present invention has been accomplished to provide a lamp socket which eliminates the aforesaid problem. It is the principal object of the present invention to provide a water-tight lamp socket which effectively prohibits water from passing to the inside when it is used outdoors. According to one aspect of the present invention, the socket body comprises a recessed portion at one end of the wire groove thereof to receive the horizontal top section of the side metal contact plate, permitting the horizontal top section of the side metal contact plate to be disposed in flush with the wire groove, two upright sliding grooves disposed at two opposite sides of the recessed portion to receive two opposite projections of the side metal contact plate, and two opposite pairs of projections bilaterally raised from the periphery at two opposite ends relative to the wire groove for engagement with respective mounting grooves at the bottom side of the pressure block of the socket cap. According to another aspect of the present invention, a rubber packing ring is mounted around the socket body outside the wire groove, having two recessed portions respectively disposed at two opposite ends of the wire groove, two water sealing retainers are respectively mounted around the electric wire and set in the recessed portions of the rubber packing ring to prohibit water from entering the wire groove. According to still another aspect of the present invention, a water sealing ring is mounted within the socket body around the base of the lamp bulb to prohibit water from entering the inside of the socket body through the gap between the socket body and the lamp bulb.

DETAILED DESCRIPTION OF THE PREFERRED EMBODIMENTS

Figure 1:
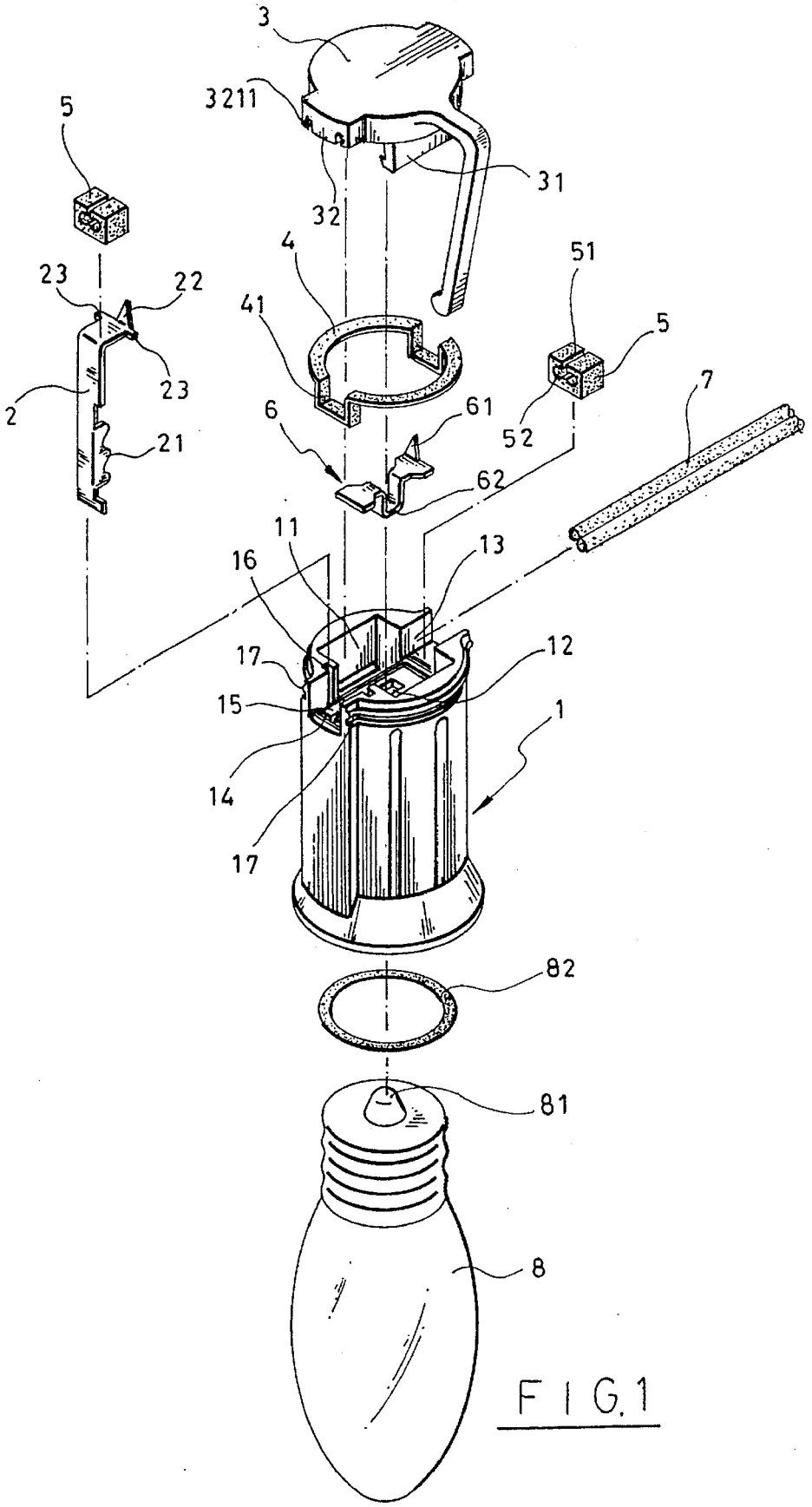
FIG. 1 is an exploded view of a water-tight lamp socket according to the present invention.

Referring to FIG. 1, a lamp socket in accordance with the present invention is generally comprised of a socket body 1, and a socket cap 3 fastened to the socket body 1 to hold down an electric wire 7 in a wire groove 13 at one end of the socket body 1. A side metal contact plate 2 and a center metal contact plate 6 are respectively mounted in the socket body 1. The socket body 1 comprises two socket cap mounting slots 11 at two opposite sides by the wire groove 13 for mounting the socket cap 3, and a center slot 12 for mounting the center metal contact plate 6. The center metal contact plate 6 is mounted in the wire groove 13 of the socket body 1, having a downward projecting contact portion 62 inserted into the center slot 12 for contact 81 with the tip contact of the lamp bulb 8, and a pointed, triangular upright tip 61 for piercing the insulator of the electric wire 7 to make contact with one conductor thereof. The socket cap 3 has two downward hooks 31 respectively fastened to the socket cap mounting slots 11 of the socket body 1.

Figure 2:
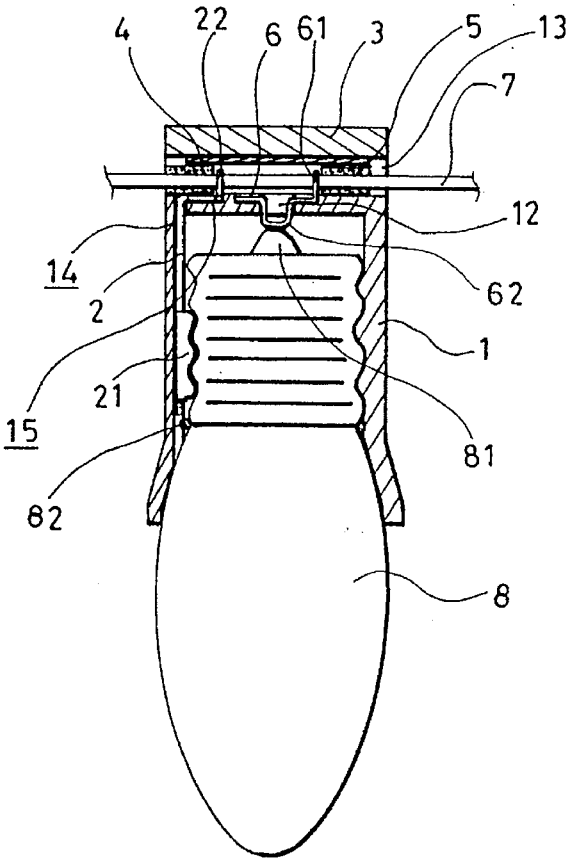
FIG. 2 is a sectional plain view of the water-tight lamp socket shown in FIG. 1.
Figure 3:
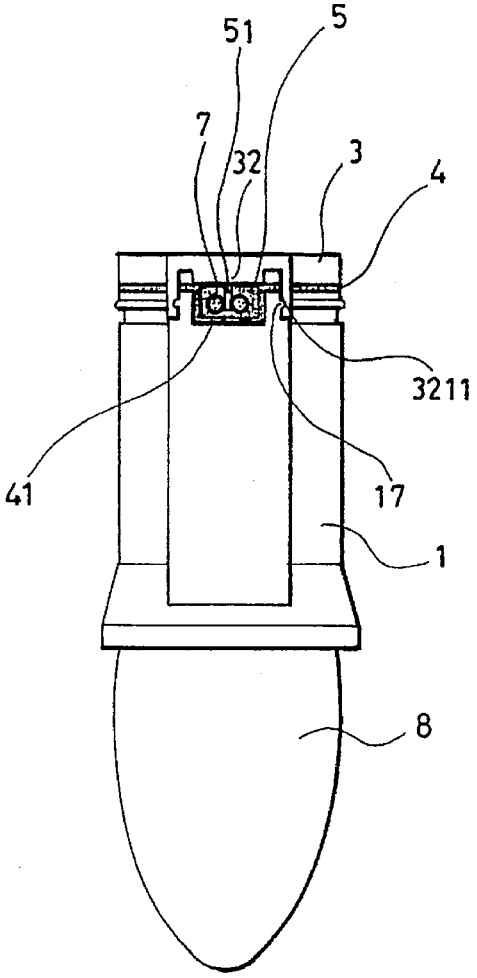
FIG. 3 is another sectional plain view of the water-tight lamp socket shown in FIG. 1 taken from another angle.

Referring to FIGS. 2 and 3, and FIG. 1 again, the socket body 1 further comprises a recessed portion 15 at one end of the wire groove 13, a T-slot 14 through the recessed portion 15, two upright sliding grooves 16 bilaterally disposed at one end of the wire groove 13, and two symmetrical pairs of projections 17 bilaterally raised from the periphery at two opposite ends. The side metal contact plate 2 is made of substantially L-shaped configuration, comprising a serrated contact portion 21 of T-shaped cross section inserted into the T-slot 14, two symmetrical projecting portions 23 forced into the upright sliding grooves 16 and then stopped inside the recessed portion 15 in the wire groove 13, and a pointed top upright tip 22 for piercing the insulator of the electric wire 7 to make electric contact with one conductor thereof. When side metal contact plate 2 is installed, it is disposed in flush with the surface of the wire groove 13 with only the pointed top upright tip 22 projecting upwards from the wire groove 13 for piercing the insulator 7 of the electric wire 7 to make electric contact with one conductor thereof. Because the two projecting portions 23 are respectively forced into engagement with the upright sliding grooves 16, the side metal contact plate 2 does not displace after its installation. The aforesaid arrangement prohibits a person to pull the side metal contact plate 2 out of the socket body 1 from the inside.

Referring to FIGS. 1, 2, and 3 again, the socket cap 3 comprises a pressure block 32 having two mounting grooves 3211 at the bottom side thereof for engagement with the projections 17 of the socket body 1. Two water sealing retainers 5 are respectively mounted around the electric wire 7 and set into the wire groove 13 of the socket body 1 at two opposite ends, each water sealing retainer 5 having a wire hole 52 for receiving the electric wire 7 and a split 51 for permitting the electric wire 7 to be forced into the wire hole 52. A rubber packing ring 4 is mounted around the socket body 1 at one end, having two recessed portions respectively disposed at two opposite ends of the wire groove 13 of the socket body 1. During the assembly process of the lamp socket, the water sealing retainers 5 are respectively mounted around the electric wire 7 and set in the recessed portions 41 of the rubber packing ring 4, and the socket cap 3 is fastened to the socket body 1 to hold down the water sealing retainers 5 and the electric wire 7 by hooking the downward hooks 31 in the socket cap mounting slots 11 and engaging the mounting grooves 3211 with the projections 17. Furthermore, a water sealing ring 82 is mounted around the base 81 of the lamp bulb 8 within the socket body 1 to prohibit water from entering the inside of the socket body 1 through the gap between the socket body 1 and the lamp bulb 8.

Figure 4:
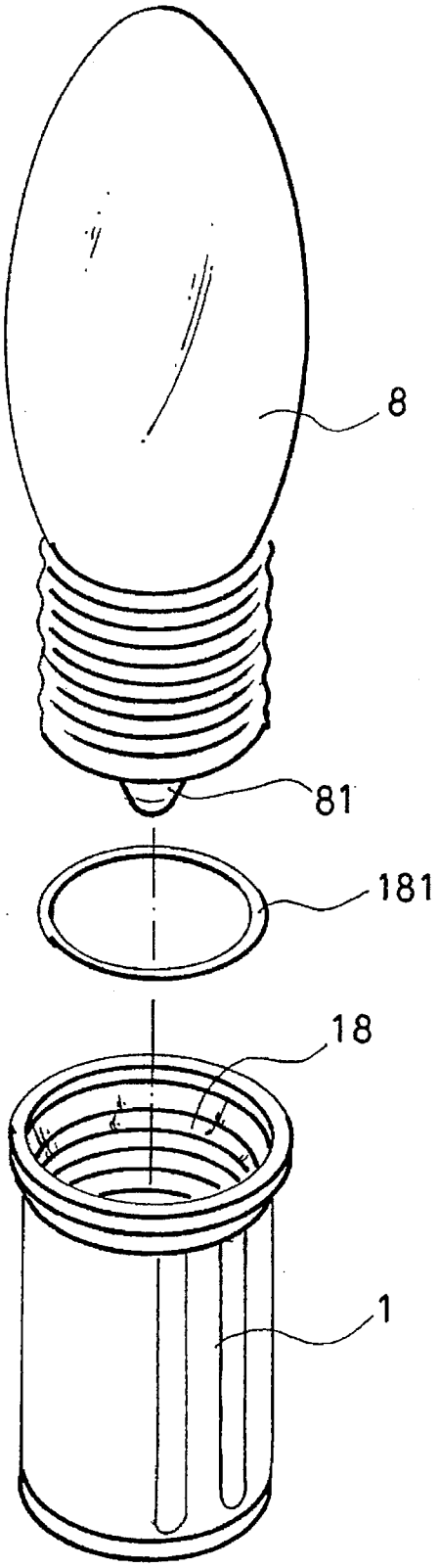
FIG. 4 shows an alternate form of the present invention.

Referring to FIG. 4, an inside annular groove 18 is made around the inside wall of the socket body 1 for mounting a water sealing ring 181 to prohibit water from entering the inside of the socket body 1 through the gap between the socket body land the lamp bulb 8.

We claim:

1. A water-tight lamp socket of the type comprising a socket body to hold a lamp bulb, said socket body having a wire groove, two socket cap mounting slots, a center slot through said wire groove, and a T-shaped side slot through said wire groove, an electric wire mounted in said wire groove, a socket cap fastened to said socket body to hold down said electric wire, said socket cap having two downward hooks respectively hooked in said socket cap mounting slots, and a pressure block pressed against said electric wire, a center metal contact plate mounted in said center slot and having a pointed tip disposed in contact with one conductor of said electric wire, and a side metal contact plate mounted in said T-shaped side slot and having a pointed tip raised from a horizontal top section thereof and disposed in contact with one conductor of said electric wire, wherein:

said socket body further comprises a recessed portion at one end of said wire groove around said T-shaped side slot to receive the horizontal top section of said side metal contact plate, permitting the horizontal top section of said side metal contact plate to be disposed in flush with said wire groove, two upright sliding grooves disposed at two opposite sides of said recessed portion to receive two opposite projections of said side metal contact plate, and two opposite pairs of projections bilaterally raised from the periphery at two opposite ends relative to said wire groove;

said side metal contact plate has two projections raised from the horizontal top section thereof at two opposite sides and respectively forced into engagement with the upright sliding grooves of said socket body;

a rubber packing ring is mounted around said socket body outside said wire groove, having two recessed portions respectively disposed at two opposite ends of said wire groove;

two water sealing retainers are respectively mounted around said electric wire an set in the recessed portions of said rubber packing ring;

a water sealing ring is mounted within said socket body around the base of said lamp bulb to prohibit water from entering the inside of said socket body through the gap between said socket body and said lamp bulb;

the pressure block of said socket cap is pressed against said water sealing retainers to hold down said electric wire, having mounting grooves at a bottom side thereof respectively forced into engagement with the projections of said socket body.

2. The water-tight lamp socket of claim 1 wherein said socket body has an inside annular groove around the inside wall thereof, which receives said water sealing ring.

* * * * *